US005944262A

United States Patent [19]

Akutagawa et al.

[11] Patent Number: 5,944,262

[45] Date of Patent: Aug. 31, 1999

[54] FUEL INJECTION VALVE AND ITS MANUFACTURING METHOD

[75] Inventors: Masaki Akutagawa; Eiji Iwanari, both of Chiryu; Yukio Sawada, Anjo; Hideto Takeda, Kariya, all of Japan

[73] Assignee: Denso Corporation, Kariya, Japan

[21] Appl. No.: 09/019,030

[22] Filed: Feb. 5, 1998

[30] Foreign Application Priority Data

| | | | |
|---|---|---|---|
| Feb. 14, 1997 | [JP] | Japan | 9-030402 |
| May 16, 1997 | [JP] | Japan | 9-126972 |
| Jun. 4, 1997 | [JP] | Japan | 9-145674 |

[51] Int. Cl.[6] ..... F02M 51/00

[52] U.S. Cl. ..... 239/585.4; 239/585.1

[58] Field of Search ..... 239/585.1, 585.4, 239/585.5

[56] References Cited

FOREIGN PATENT DOCUMENTS

| | | |
|---|---|---|
| 8-3643 | 9/1996 | Japan . |
| WO 91/11611 | 8/1991 | WIPO . |

*Primary Examiner*—Lesley D. Morris
*Attorney, Agent, or Firm*—Nixon & Vanderhye P.C.

[57] ABSTRACT

A fuel injection valve, having an injector pipe containing a needle valve therein, an electromagnetic coil for driving the needle valve and a yoke forming a magnetic circuit, intermittently injects fuel fed from the top of the injection valve to an internal combustion engine according to longitudinal movement of the needle valve. The injector pipe is made of a compound magnetic material and formed into a single piece by a drawing process, the single piece including two magnetic portions and a non-magnetic portion interposed between two magnetic portions. The non-magnetic portion intercepts magnetic flux flow between the magnetic portions. The electromagnetic coil is molded by resin together with other components, and the yoke is formed separately. The yoke is mounted on the molded coil from its lateral side, making an assembly including the coil and the yoke. The injector pipe is inserted into a bore formed in the coil, and then the yoke is connected to the injector pipe by welding. The yoke and the molded coil are designed so that they are automatically positioned at a right place when they are assembled. Thus, the fuel injection valve is easily assembled in a simple process and at a low cost.

7 Claims, 5 Drawing Sheets

FUEL INJECTION VALVE AND ITS MANUFACTURING METHOD

CROSS-REFERENCE TO RELATED APPLICATIONS

This application is based upon and claims benefit of priority of Japanese Patent Applications No. Hei-9-30402 filed on Feb. 14, 1997, No. Hei-9-126972 filed on May 16, 1997, and No. Hei-9-145674 filed on Jun. 4, 1997, the contents of which are incorporated herein by reference.

BACKGROUND OF THE INVENTION

1. Field of the Invention

The present invention relates to a fuel injection valve which supplies fuel fed from its top to an internal combustion engine, so called a top feed fuel injection valve, and more particularly to a fuel injection valve having an improved magnetic circuit structure and its manufacturing method.

2. Description of Related Art

An example of a top feed fuel injection valve is shown in JP-A-5-503976. In this fuel injection valve, an injector pipe is composed of a cylindrical fuel connector made of a magnetic material for connecting the injection valve to a fuel delivery pipe, a non magnetic annular member soldered to the bottom end of the cylindrical fuel connector, and a valve body made of a magnetic material soldered to the bottom end of the annular member. The injector pipe is inserted into a cylindrical molded coil, and two yokes are attached to the outside of the molded coil and soldered to the fuel connector and the valve body at their top end and bottom end, respectively. Then, a whole assembled injection valve is molded by resin. Each yoke has a curved plate-like shape and covers a part of the outside of the molded coil.

Some of conventional injection valves have a single cylindrical yoke into which a cylindrical molded coil is inserted. In this structure, the yoke must have an opening larger than the outer diameter of the molded coil, and, accordingly, the yoke opening cannot be directly attached to the outer periphery of the molded coil. So, a magnetic ring has to be inserted between the yoke opening and the injector pipe to form a closed magnetic circuit. This structure requires an additional part, the magnetic ring, and makes its assembling process complex.

The injection valve disclosed in the publication recited above is intended to solve the problem of the conventional injection valves. However, there still remains a problem in its assembling process. That is, the injection pipe has to be inserted into the cylindrical molded coil using a jig to set the injection pipe at a right position in the molded coil, and the yokes have to be positioned at a right place of the outer periphery of the molded coil with help of a jig. This assembling process is inefficient and makes its cost high. Moreover, after the yokes are assembled to the molded coil, a whole assembly has to be molded into one piece by resin, and an annular member to support a sealing member (an O-ring) has to be formed on the upper end portion of the fuel connector. This also makes the assembling process inefficient and makes the assembling cost high.

SUMMARY OF THE INVENTION

The present invention has been made in view of the above-mentioned problems, and an object of the present invention is to provide a fuel injection valve which is assembled efficiently in a simplified process, eliminating a molding process after assembling. Another object of the present invention is to provide a simplified method of manufacturing the fuel injection pump.

The fuel injection valve according to the present invention includes: an injection pipe having an open end and a closed end, the closed end having an injection port from which fuel fed from the open end is injected; valve elements including a needle valve for closing and opening the injection port; a molded coil, disposed on the outer periphery of the injector pipe, for electromagnetically driving the needle valve; and a yoke, disposed to cover the outside of the molded coil, for forming a magnetic circuit in cooperation with the molded coil and the injector pipe. The injector pipe is made of a compound magnetic material, and upper portion and lower portion thereof have a magnetic property while an intermediate portion interposed between the upper and lower portions has a non-magnetic property. The intermediate portion intercepts the magnetic circuit. Fuel supplied from the top of the injection valve is intermittently injected from the injection port according to the operation of the needle valve.

The yoke includes an opening through which the yoke is mounted on the molded coil from the lateral side of the molded coil, a pair of magnetic pieces for forming the magnetic circuit, and upper and lower connecting portions for connecting the yoke to the injector pipe by welding. In the assembling process, the yoke is first mounted on the molded coil from its lateral side through the opening of the yoke and exactly positioned on the molded coil by means of a positioning member formed on the yoke and the molded coil. Then, the injector pipe is inserted into a bore formed on the molded coil, and both connecting portions of the yoke are connected to the outside surface of the injector pipe by welding. In this manner, components of the fuel injection valve are efficiently assembled in a simple process.

Preferably, a connector housing containing a connector terminal for supplying electric current to the molded coil is molded integrally with the molded coil. Also, a member for supporting a sealing member which seals a portion connecting the fuel injection valve to a fuel delivery pipe may be formed integrally with the molded coil by molding resin. When these parts or members are molded integrally with the molded coil, a molding process after assembling the injector pipe, the molded coil and the yoke can be eliminated.

Preferably, a pair of magnetic pieces of the yoke are connected to each other by the lower connecting portion which is ring-shaped, thereby making the yoke in a single integral piece. The injector pipe is inserted into a bore of the ring-shaped lower connecting portion so that the outer periphery of the injector pipe contacts the inner bore throughout its entire circle, thereby making magnetic resistance between the yoke and the injector pipe small. The pair of magnetic pieces may be connected by the upper connecting portion of the yoke, or both of the upper and lower connecting portions.

Other objects and features of the present invention will become more readily apparent from a better understanding of the preferred embodiment described below with reference to the following drawings.

DETAILED DESCRIPTION OF THE PREFERRED EMBODIMENT

Figure 1:
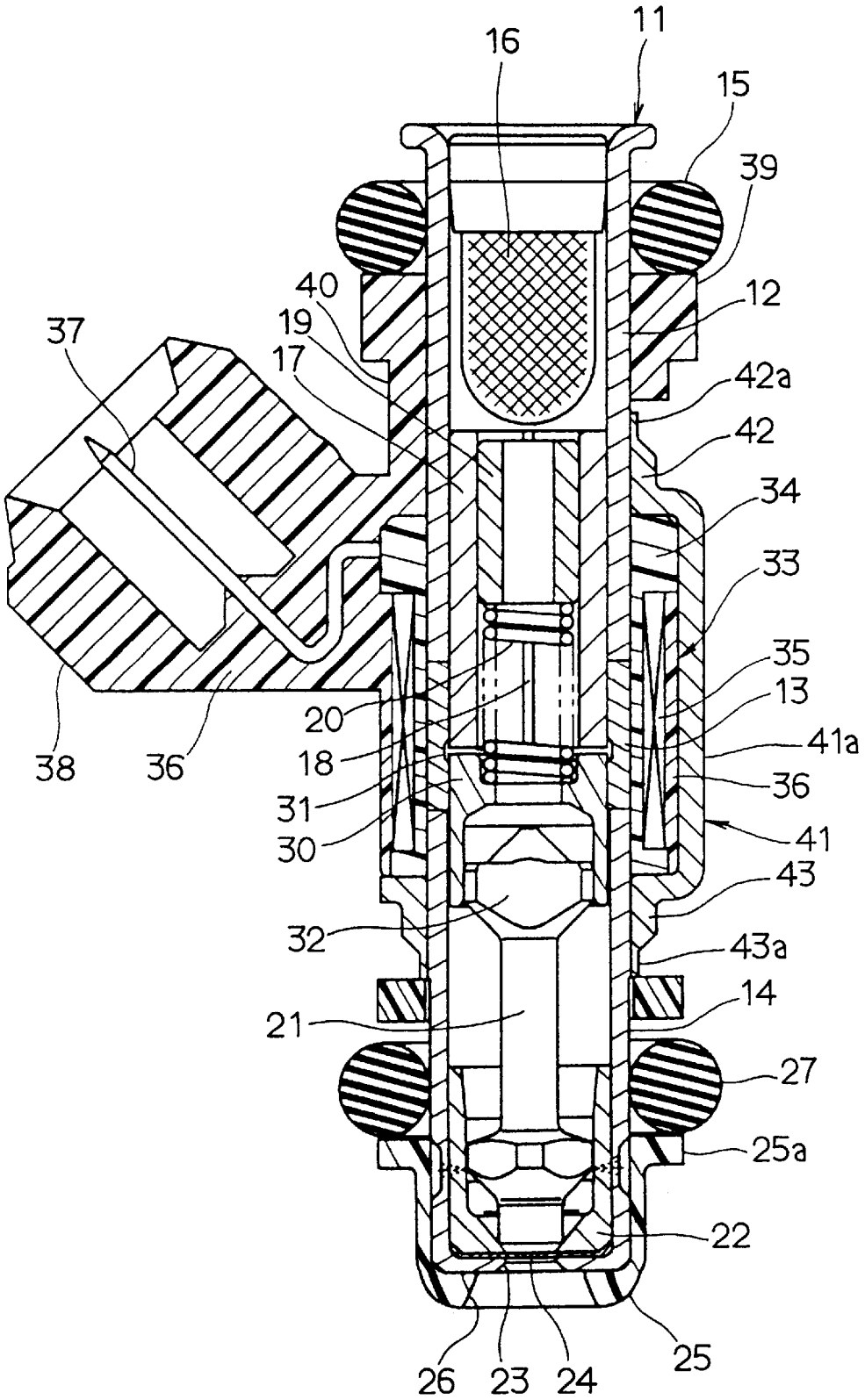
FIG. 1 is a cross-sectional view showing a whole structure of a fuel injection valve according to the present invention.

Referring to drawings, an embodiment according to the present invention will be described. FIG. 1 shows a whole structure of a fuel injection valve. Injector pipe 11 is made of a compound magnetic material, and includes upper portion 12 for connecting the injection valve to a fuel delivery pipe of an internal combustion engine, intermediate portion 13 and lower portion 14 containing valve seat 22 and other valve elements therein. Upper portion 12 and lower portion 14 of injector pipe 11 are treated so that they have magnetic property while intermediate portion 13 has non-magnetic property in the process described later.

As the material forming injector pipe 11, the compound magnetic material described in JP-A-8-3643 may be used. The compound magnetic material is composed of following components: less than 0.6 weight-percent of carbon (C); 12 to 19 weight-percent of chromium (Cr); 6 to 12 weight-percent of nickel (Ni); less than 2 weight-percent of manganese (Mn); less than 1 weight-percent of niobium (Nb); and iron (Fe) and other unavoidable impurities for the rest. Hirayama's equivalent weight (Heq) is 20 to 23%, nickel equivalent weight (Nieq) is 9 to 12%, and chromium equivalent weight (Creq) is 16 to 19%, these equivalent weights being defined as follows:

$$Heq=[Ni\%]+1.05[Mn\%]+0.65[Cr\%]+0.35[Si\%]+12.6[C\%]$$

$$Nieq=[Ni\%]+30[C\%]+0.5[Mn\%]$$

$$Creq=[Cr\%]+[Mo\%]+1.5[Si\%]+0.5[Nb\%]$$

Figure 2A:
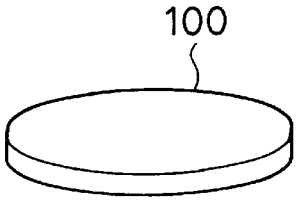
FIGS. 2A to 2F are schematic drawings showing manufacturing processes of an injector pipe used in the fuel injection valve shown in FIG. 1.
Figure 2B:
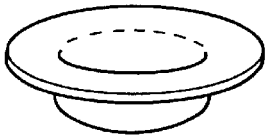
Figure 2C:
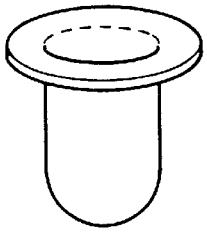
Figure 2D:
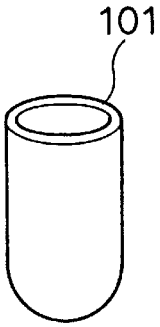
Figure 2E:
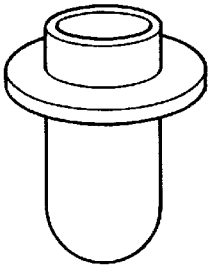
Figure 2F:
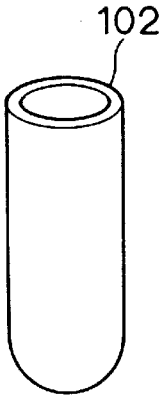
Figure 3A:
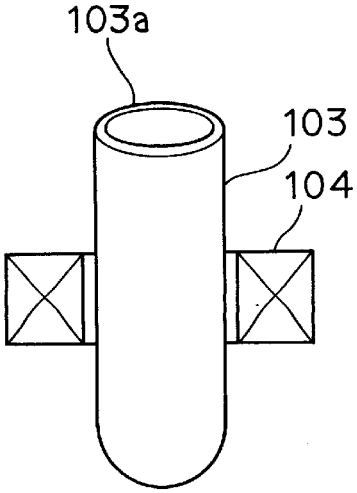
FIGS. 3A and 3B are schematic drawings showing a heat treatment process to form magnetic and non-magnetic portions on the injector pipe.
Figure 3B:
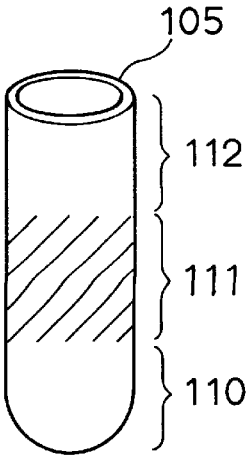

Injector pipe 11 is formed into its shape from a plate made of the compound magnetic material described above in the processes shown in FIGS. 2A to 2F. Round plate 100 (FIG. 2A) to which magnetic property is not yet given is drawn into a cup shape (FIG. 2B) by presswork. It is further drawn into a shape shown in FIG. 2C and further into a shape of elongated cup 101 shown in FIG. 2D. Elongated cup 101 is further drawn into a shape shown in FIG. 2E, and finally into a shape of elongated cup 102 shown in FIG. 2F. During the drawing process magnetic property is given to the compound magnetic material by keeping its temperature at a level lower than 100° C. In this process, the whole elongated cup 102 is given magnetic property so that its flux density in a magnetic field of 4000 A/m becomes higher than 0.3. In other words, the compound magnetic material is brought to a martensitic state through the drawing process. Then, the open end of elongated cup 102 is cut to a required length. As shown in FIGS. 3A and 3B, elongated cup 103 having a required length is placed in magnetic coil 104, and a part of the cup at a predetermined distance from its opening 103*a* is heated by electromagnetic induction heating for a period less than 10 seconds. Heated part 111 of the cup is brought to a austenite state having no magnetic property, while other parts 110 and 112 remain in the martensite state having magnetic property. The crystal size of the austenitized part is made less than 3 $\mu$m so that the non-magnetic property is stably kept even at a very low temperature. Thus, elongated cup 105 having non-magnetic portion 111 and magnetic portions 110 and 112 is completed. It is also possible to draw a plate made of a compound magnetic material having magnetic property before the drawing process into a cup shape and then to convert a required part to a part having no magnetic property. In any case, the elongated cup having a non-magnetic portion interposed between two magnetic portions can be made in a single piece in the simple process mentioned above. It is not necessary to assemble three portions having different magnetic properties by soldering or the like.

Cup 105 (FIG. 3B) is machined into the shape of injector pipe 11 shown in FIG. 1. Magnetic portion 112 corresponds to upper portion 12 of injector pipe 11, non-magnetic portion 111 to intermediate portion 13, and magnetic portion 110 to lower portion 14. As shown in FIG. 1, sealing member 15 such as an O-ring is disposed at an upper end portion of injector pipe 11 for sealing the connection between the delivery pipe and injector pipe 11. Filter 16 for filtering fuel sent from the delivery pipe to the injection valve is also disposed in an upper inside portion of injector pipe 11. Stationary core 17 is press-fitted in the bore of injector pipe 11, and its lower end extends to a middle portion of nonmagnetic intermediate portion 13. Slit 18 is formed on stationary core 17 so that the outer diameter of stationary core 17 flexibly shrinks when stationary core 17 is press-fitted in the inner bore of injector pipe 11. After stationary core 17 is press-fitted in the bore, it is firmly gripped therein by spring back action of stationary core 17 itself. Adjuster pipe 19 is press-fitted in the inner bore of stationary core 17 at its upper portion. Underneath adjuster pipe 19, spring 20 is disposed, and its downward biasing force is adjusted by changing the axial position of adjuster pipe 19. Adjuster pipe 19 may be disposed in the inner bore of stationary core 17 by screw engagement, though it is press-fitted in the particular embodiment shown in FIG. 1. Fuel fed through filter 16 passes through the inner bore of adjuster pipe 19 and spring 20.

The bottom end of injector pipe 11 is closed leaving an opening for injector port 23. Needle valve 21 is disposed in lower portion 14 of injector pipe 11. Cylindrical valve seat 22 is inserted in the bottom portion of injector pipe 11 and fixed to the inner bore of injector pipe 11, for example, by laser seam welding. Valve seat 22 has an opening formed at its bottom end so that the opening coaxially faces injection port 23 of injector pipe 11. Injection plate 24 having one or more injection holes is interposed between the bottom end of valve seat 22 and the bottom end of injector pipe 11. The injection holes of injection plate 24 are located to face injection port 23. An outer periphery of injection plate 24 is bent upward so that its outer periphery fits an chamfer formed at the bottom end periphery of valve seat 22. Since injection plate 24 is tightly held between the bottom end of valve seat 22 and the bottom end of injector pipe 11, its downward deformation due to fuel pressure is avoided. Accordingly, fuel can be injected form the injection valve in a predetermined direction, without being affected by the fuel pressure. Protecting cover 25 made of resin having center opening 26 is fixed to the bottom end of injector pipe 11. Opening 26 coaxially faces injection port 23 of injector pipe 11. O-ring 27 for sealing the connection between the fuel injection valve and an intake manifold of an engine is disposed on the outer periphery of injector pipe 11 and supported by flange 25*a* of protecting cover 25.

Cylindrical moving core 30 is fixed to the upper end of needle valve 21 and disposed slidably in the inner bore of injection pipe 11. The upper end surface of moving core 30 is positioned at an approximate center of non-magnetic intermediate portion 13 of injection pipe 11. Moving core 30 is biased downward by spring 20, making a small gap between its upper end and the bottom end of stationary core 17. Annular ditch 31 is formed on the inner bore of intermediate portion 13 at a position corresponding to the small gap to help smooth sliding of moving core 30 in the inner bore of injection pipe 11. Plural chamfers 32 are formed on the outer periphery of a large diameter portion of needle valve 21 so that fuel can pass through the chamfered portion.

Figure 4:
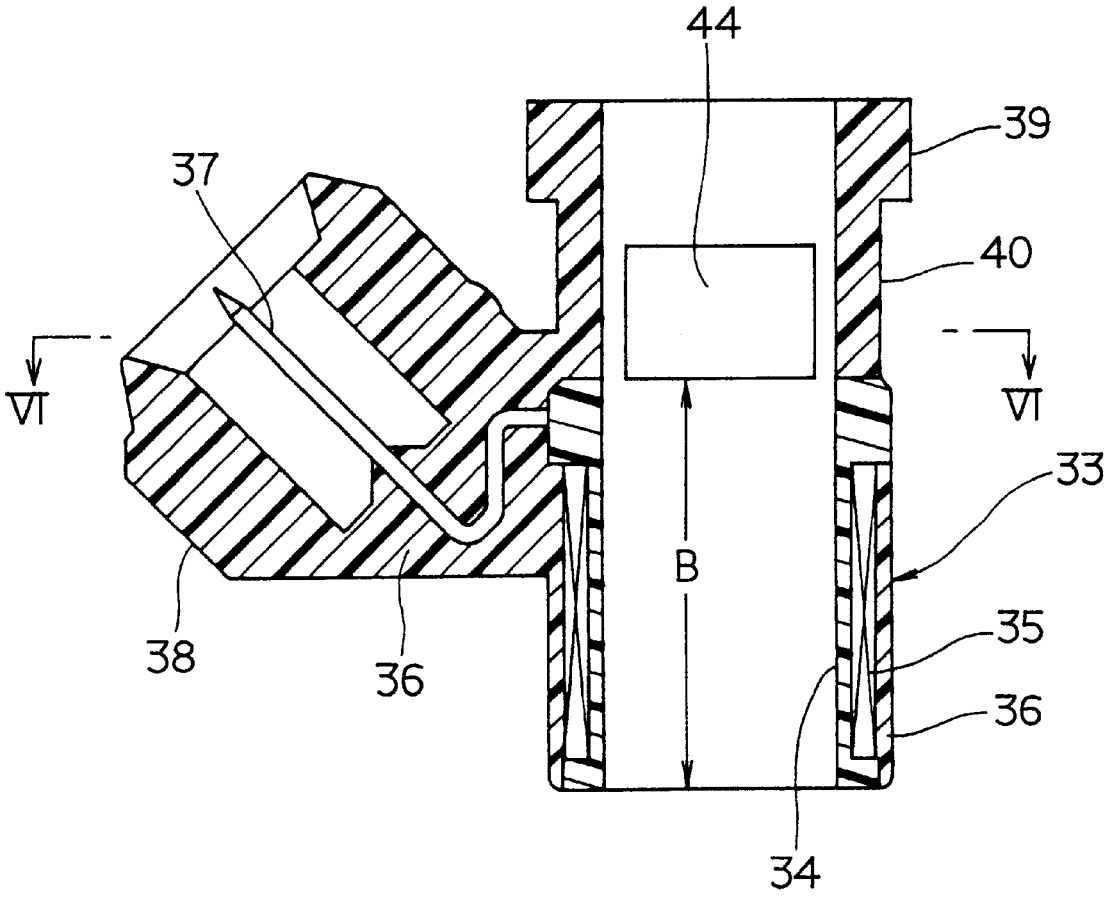
FIG. 4 is a cross-sectional view showing a connector housing and a molded coil, both being in one piece.
Figure 5A:
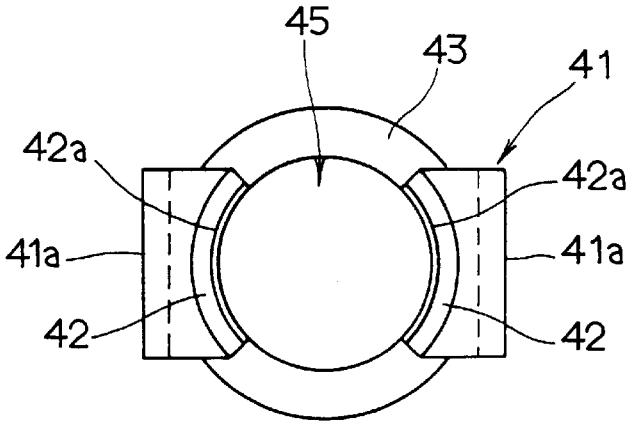
FIG. 5A is a top view showing a yoke used in the fuel injection pump shown in FIG. 1.
Figure 5B:
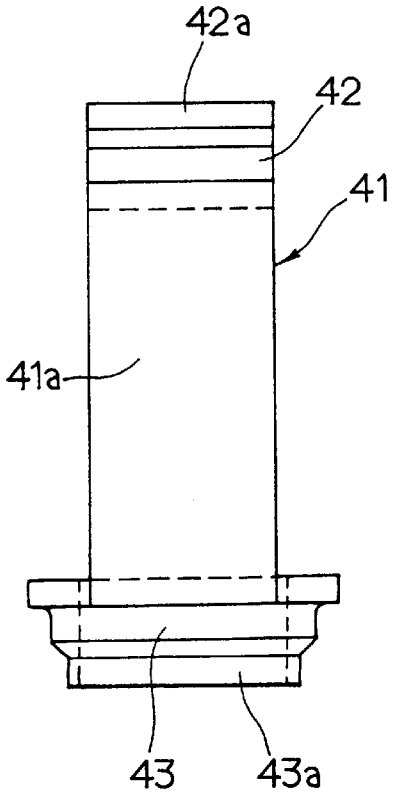
FIG. 5B is a side view showing the yoke.
Figure 5C:
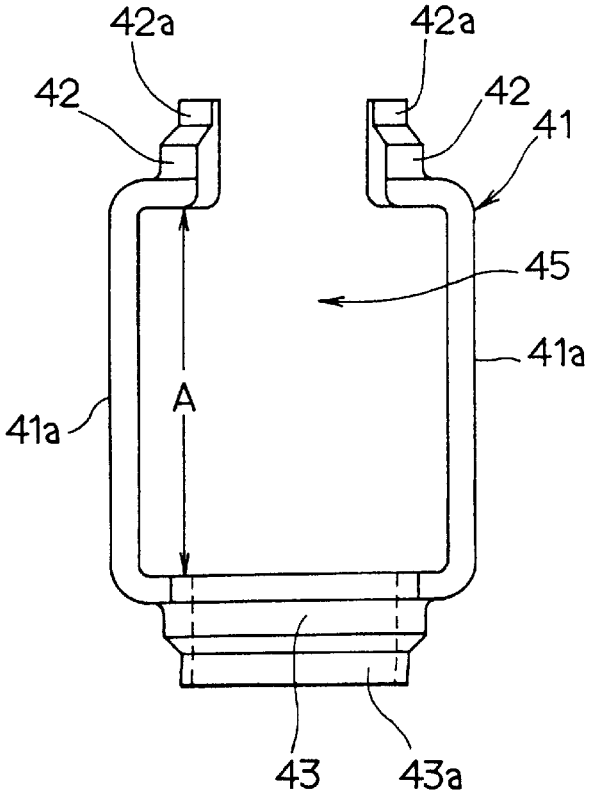
FIG. 5C is a front view showing the yoke.

Injector pipe 11 is inserted into the inner bore of molded coil 33 shown in FIG. 4. A yoke 41 shown in FIGS. 5A to 5C is assembled to molded coil 33 from its side (in a direction perpendicular to the axis of molded coil 33) so that yoke 41 covers the outside of molded coil 33. Coil 35 is wound on spool 34 and, then, molded with insulating resin 36 into one piece together with connector housing 38 including connector terminal 37 and seal member stopper 39. Connector terminal 37 is electrically connected to coil 35 to supply electric power thereto. A pair of windows 44 for receiving a part of yoke 41 are formed on cylindrical portion 40 connecting seal member stopper 39 and molded coil 33.

As shown in FIGS. 5A to 5C, yoke 41 is made of a magnetic material and composed of a pair of magnetic pieces 41*a*, upper connecting portion 42 formed on the upper end of each magnetic piece 41*a* and lower connecting portion 43 formed on the lower end of magnetic pieces 41*a*. Lower connecting portion 43 connects two magnetic pieces 41*a* together, thereby forming yoke 41 into a single piece. Upper connecting portion 42 is arc-shaped so that it tightly fits the outer diameter of injector pipe 11 when both are assembled. Lower connecting portion 43 has an inner diameter which fits the outer diameter of injector pipe 11 when both are assembled. Thin lip 42*a* for connecting yoke 41 to injector pipe 11 by laser welding is formed on the top end of each upper connecting portion 42. Thin lip 43*a* is formed on the bottom end of lower connecting portion 43 for the same purpose. Opening 45 for assembling yoke 41 with molded coil 33 from its side is formed between a pair of magnetic pieces 41*a*. Height "B" shown in FIG. 4 which is a distance from the bottom end of molded coil 33 to the lower side of window 44 is made equal to height "A" shown in FIG. 5C which is a height of opening 45, so that an inner shoulder of upper connecting portion 42 fits into window 44 and the bottom surface of opening 45 fits with the bottom end of molded coil 33 when yoke 41 is assembled to the molded coil 33 from a direction perpendicular to the axial direction of molded coil 33. Accordingly, yoke 41 is exactly and automatically positioned on molded coil 33 when they are assembled together.

Figure 6A:
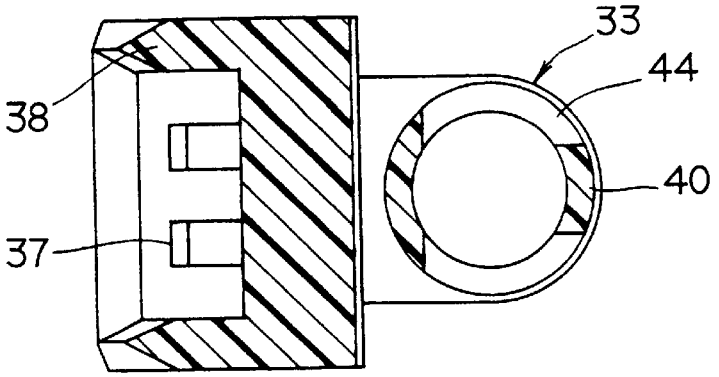
FIGS. 6A to 6D are cross-sectional views, taken along a line VI—VI in FIG. 4, showing assembling processes of the fuel injection valve according to the present invention.
Figure 6B:
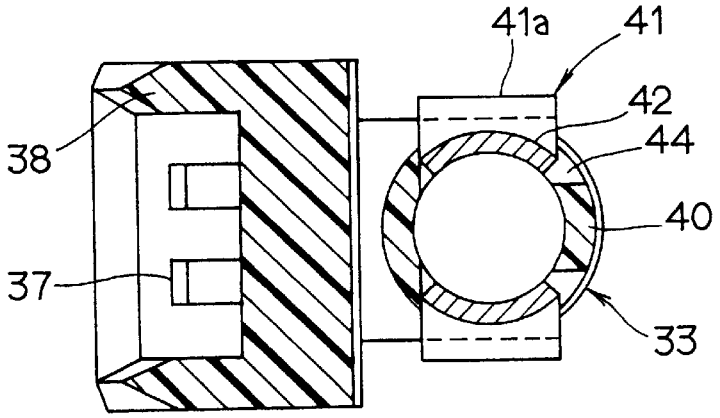
Figure 6C:
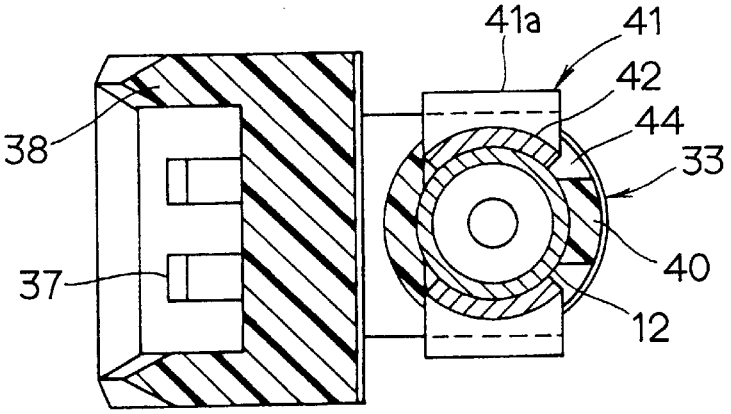
Figure 6D:
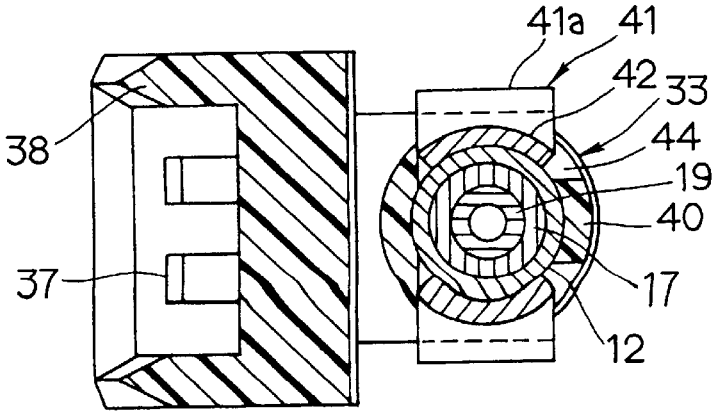

The process of assembling yoke 41, molded coil 33 (which includes connector housing 38 and seal member stopper 39 molded together as a single piece) and injector pipe 11 will be described, referring to FIGS. 6A to 6D. FIGS. 6A to 6D are cross-sectional views taken along a line VI—VI in FIG. 4. FIG. 6A shows molded coil 33 only, when yoke 41 is not yet assembled. FIG. 6B shows a state where yoke 41 is assembled with molded coil 33. Yoke 41 is moved from the right side of the drawing toward molded coil 33, and molded coil 33 is connected to yoke 41 through opening 45 of the yoke so that the lower shoulder of upper connecting portion 42 of the yoke fits in window 44 of molded coil 33 and the bottom surface of opening 45 of the yoke receives the bottom end of molded coil 33. Thus, yoke 41 is connected to molded coil 33 at its exact position automatically. Then, as shown in FIG. 6C, injector pipe 11 is inserted into yoke 41 through upper connecting portion 42 and lower connecting portion 43 of the yoke. When yoke 41 and injector pipe 11 are assembled together, arc-shaped upper connecting portion 42 and the inner bore of lower connecting portion 43 contact the outer periphery of injector pipe 11. Upper thin lips 42*a* and lower thin lip 43*a* are connected to the outer surface of injector pipe 11, for example, by laser welding. Then, as shown in FIG. 6D, all the components, such as valve seat 22, needle valve 21, moving core 30, spring 20, adjuster pipe 19 and filter 16, are inserted into injector pipe 11 and assembled together. It is, of course, possible to assemble these components in injector pipe 11 before injector pipe 11 and molded coil 33 are assembled.

The operation of the fuel injection valve made as described above will be briefly explained. When no current is supplied to coil 35, moving core 30 is biased downward by spring 20 thereby closing the injection holes of injection plate 24 by pushing down needle valve 21 against injection plate 24. When coil 35 is energized, magnetic flux is generated and flows through a magnetic circuit surrounding coil 35. The magnetic circuit is composed of yoke 41, upper connecting portion 42, upper portion 12 of the injector pipe, stationary core 17, moving core 30, lower portion 14 of the injector pipe, lower connecting portion 43 and yoke 41. Non-magnetic intermediate portion 13 interrupts magnetic flux flow between upper portion 12 and lower portion 14. Moving core 30 is attracted to stationary core 17 when the magnetic flux flows through the magnetic circuit, thereby opening the injection holes of injection plate 24. Thus, fuel fed from the top of the injection valve is injected through the injection holes.

Since yoke 41 is mounted on molded coil 33 at a desired position automatically by inserting yoke 41 into molded coil 33 from the lateral side of molded coil 33, both can be assembled in a simple process. After the molded coil and the yoke are assembled, injector pipe 11 is inserted into the bore of the molded coil and connected to thin lips 42*a* and 43*a* of the yoke by welding. Therefore, the assembling process of the fuel injection valve as a whole is simplified. Moreover, since sealing member stopper 39 is integrally molded with molded coil 33, no molding process is needed after assembling. Since lower connecting portion 43 of the yoke contacts injector pipe 11 with its entire bore surface, magnetic resistance between the yoke and the injector pipe is low, and a high mechanical strength of connection can be attained. Since two magnetic pieces 41*a* of the yoke are symmetrically positioned, magnetic flux flow in the magnetic circuit is also symmetrical with respect to the center axis of coil 35. Accordingly, moving core 30 can be driven smoothly in the bore of stationary core 17. Since injector pipe 11 having two magnetic portions and one non-magnetic portion is formed in a drawing process as a single piece, there is no need to connect three separate elements by welding or soldering.

The preferred embodiment described above may be modified in various ways without departing from the scope of the present invention as defined in the appended claims. For example, lower connecting portion 43 of the yoke having an annular ring shape may be divided into separate two or more pieces, and upper connecting portions 42 may be connected so that a pair of magnetic pieces 41*a* are connected to each other. Though upper and lower connecting portions 42 and 43 are used also as members for positioning the yoke relative to the molded coil in the embodiment described above, the positioning member may be made separately from the connecting portions. The number of magnetic pieces is not limited to two but it may be three or more, as long as opening 45 for assembling is secured. Injector pipe 11 may be made by connecting three pieces having different magnetic properties by welding or soldering. Though sealing member stopper 39 and connector housing 38 are molded together with molded coil 33 in the embodiment described above, one of them or both of them may be separately formed.

What is claimed is:

1. A fuel injection valve comprising:

an injector pipe with an upper end opened and a lower end closed except an injection port, the injector pipe having a magnetic upper portion, a non-magnetic intermediate portion and a magnetic lower portion;

a molded coil surrounding a part of an outer surface of the injector pipe, the part including the non-magnetic intermediate portion; and a yoke mounted on the molded coil from a lateral side of the molded coil; wherein:

the yoke includes an opening for mounting the yoke on the molded coil from the lateral side of the molded coil, a member for positioning the yoke relative to the molded coil in its axial direction, and upper and lower connecting portions for connecting the yoke to the outer surface of the injector pipe.

2. A fuel injection valve as in claim 1, wherein a connector housing having a connector terminal for supplying electric current to the molded coil is molded by resin integrally with the molded coil.

3. A fuel injection valve as in claim 2, wherein:

a stopper for supporting a sealing member that seals fuel fed to the fuel injection valve is molded by resin integrally with the molded coil;

a cylindrical portion connecting the stopper and the molded coil is formed; and a window for receiving therein the upper connecting portion of the yoke is formed on the cylindrical portion.

4. A fuel injection valve as in claim 1 wherein:

the yoke includes a pair of magnetic pieces; and the magnetic pieces are connected to each other by either the upper connecting portion or the lower connecting portion, thereby making the yoke an integral one piece.

5. A fuel injection valve as in claim 4, wherein:

the lower connecting portion is an annular ring connecting the pair of magnetic pieces, the annular ring having an inner bore; and the injection pipe is inserted into the inner bore of the annular ring.

6. A fuel injection valve as in claim 1, wherein:

the injector pipe is made of a compound magnetic material and formed into a single integral piece by a drawing process.

7. A method of manufacturing a fuel injection valve having: an injector pipe with an upper end opened and a lower end closed except an injection port, the injector pipe having a magnetic upper portion, a non-magnetic intermediate portion and a magnetic lower portion; a molded coil, which includes an inner bore, surrounding a part of outer surface of the injector pipe, the part including the non-magnetic intermediate portion; and a yoke, including an opening and a positioning member, mounted on the molded coil, the method comprising steps of:

mounting the yoke on the molded coil from a lateral side of the molded coil through the opening of the yoke so that the yoke is positioned by the positioning member at a predetermined position on the molded coil;

inserting the injection pipe into the inner bore of the molded coil on which the yoke is mounted; and connecting the yoke to the outer surface of the injector pipe.

* * * * *